US005201346A

United States Patent [19]

Cox

[11] Patent Number: 5,201,346

[45] Date of Patent: Apr. 13, 1993

[54] THREAD FEEDING GUIDE ARRANGEMENT TO A WEFT ACCUMULATOR TUBE

[75] Inventor: Gerardus Cox, BB Geldrop, Netherlands

[73] Assignee: Sulzer Brothers Limited, Winterthur, Switzerland

[21] Appl. No.: 848,448

[22] Filed: Mar. 9, 1992

[30] Foreign Application Priority Data

Mar. 19, 1991 [CH] Switzerland ..... 00828/91

[51] Int. Cl.[5] ..... D03D 47/30; D03D 47/34

[52] U.S. Cl. ..... 139/450; 139/452; 139/370.2; 242/47.01

[58] Field of Search ..... 139/450, 452, 370.2; 242/47.12, 47.01

[56] References Cited

U.S. PATENT DOCUMENTS

| | | | |
|---|---|---|---|
| 4,215,728 | 8/1980 | Weidman et al. | 139/450 |
| 4,362,190 | 12/1982 | Arawaka . | |
| 4,715,411 | 12/1987 | Van Bogaert et al. | 242/47.01 X |
| 4,852,617 | 8/1989 | Hamer et al. | 139/452 |
| 4,858,658 | 8/1989 | Shaw | 139/450 X |
| 4,951,718 | 8/1990 | Shaw | 139/450 |

FOREIGN PATENT DOCUMENTS

| | | |
|---|---|---|
| 0282745 | 9/1988 | European Pat. Off. . |
| 2908743 | 9/1979 | Fed. Rep. of Germany . |
| 1283528 | 7/1972 | United Kingdom . |
| WO87/04418 | 7/1987 | World Int. Prop. O. . |

*Primary Examiner*—Andrew M. Falik

*Attorney, Agent, or Firm*—Townsend and Townsend

[57] ABSTRACT

Between the supply bobbin and a thread tensioner supplied therefrom, which comprises a thread guide (12) which can rotate around an axis of rotation (11), are disposed a fixed thread guiding component (3) and an optical sensor (20) for monitoring the weft thread (2), which is guided by the sensor (20) and an inlet channel (18), which passes through the thread guide (12) in the axial direction, towards the thread tensioner (5). The inlet channel (18) of the thread guide (12) is eccentrically offset with respect to its axis of rotation (11), so that the section of the weft thread (2) running towards it is laterally deflected and a rotational movement which can be detected by the sensor (20) is imparted to this section, and enables a safe monitoring of the weft thread (2) with minimal thread tension. A guide piece which has a guide channel eccentrically disposed with respect to the axis of rotation (11) and can be mounted on the thread guide (12) may also be provided as means to deflect the weft thread (2).

6 Claims, 1 Drawing Sheet

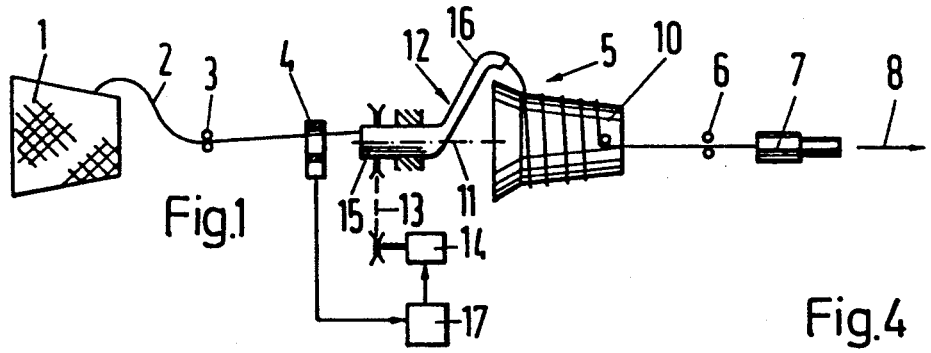
Fig.1
Fig.4
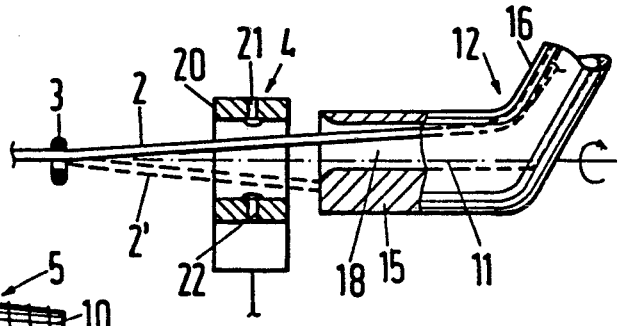
Fig.2
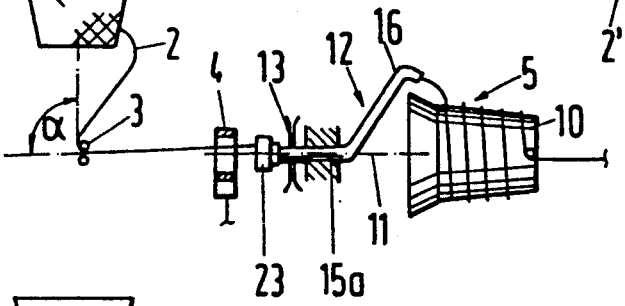
Fig.5
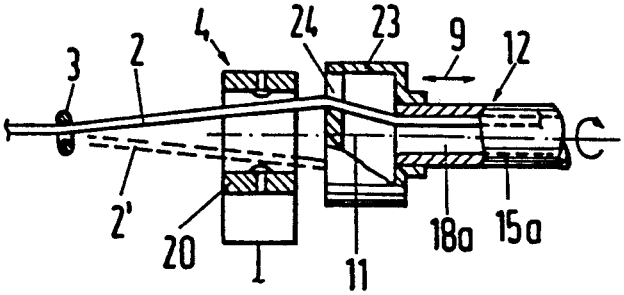
Fig.3
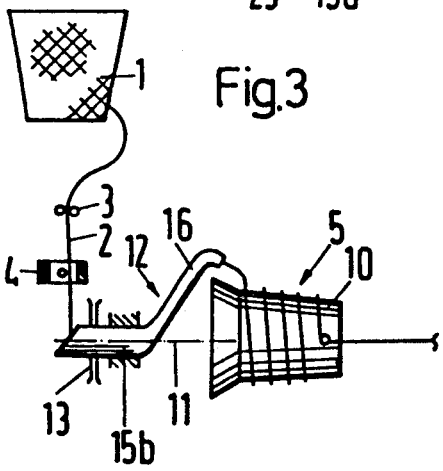
Fig.6
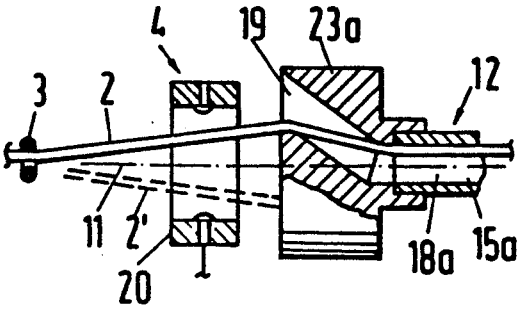
Fig.7
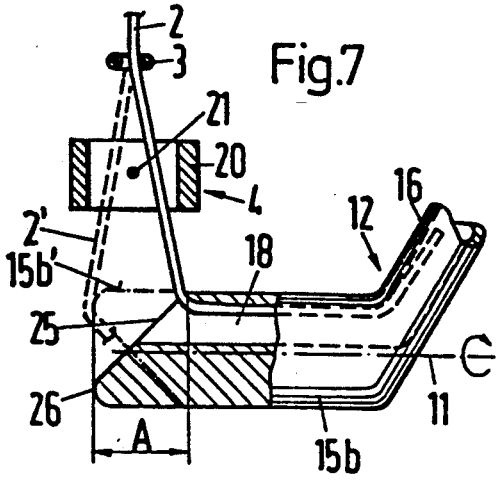

THREAD FEEDING GUIDE ARRANGEMENT TO A WEFT ACCUMULATOR TUBE

BACKGROUND OF THE INVENTION

The invention relates to a thread guiding device on a power loom having a fixed weft thread supply bobbin and a thread tensioner supplied therefrom, which comprises a thread guide, which can rotate around an axis of rotation, with an inlet channel for the weft thread passing through said thread guide in the axial direction, with a thread guiding component for the weft thread fixed between the supply bobbin and the thread tensioner and a monitoring device responding to the path of the thread between the thread guiding component and the thread tensioner.

In an appliance of this type known from German Patent Specification 29 08 743 for monitoring the weft thread supplied to the thread storage there is provided an electronic catch thread device having a thread sensor, which is excited by the moving weft thread and which is connected in series via an electronic scanning device and a logical circuit with a stop device. The power loom is switched off by means of the stop device if the weft thread breaks. Such electronic appliances require a relatively expensive control system and their function can be impaired by contamination, depending on the weft thread material being used.

To monitor the weft thread supplied to the thread storage there are also known piezoceramic components, which however require additional deflections in the weft thread so as to achieve a certain thread tension necessary for detecting the path of the thread and, as they react to the "noise" of the moving thread, their function can be impaired by ambient noise, e.g. the hissing of outgoing pressurized air in the case of pneumatic power looms.

SUMMARY OF THE INVENTION

The object of the invention is to create a thread guiding device of the aforementioned type which has been improved in particular in this respect in a simple, robust construction, which permits the weft thread supplied to the thread storage to be monitored independently of the tension of the weft thread and of environmental effects This object is achieved according to the invention in that an optical sensor through which the weft thread can pass is provided, and in that guide means for the lateral deflection of the section of the weft thread supplied thereto are associated with the thread guide.

By the design of the thread guiding device specified by the invention there is achieved a simple, gentle guiding action and a safe monitoring of the weft thread with minimal thread tension, with the guide means specified by the invention to produce deflection movements of the weft thread interfering with the path of the thread enabling the use of an optical sensor previously provided in particular to monitor ballooning threads for monitoring the weft thread supplied to the thread storage in the extended state. The sensor is automatically cleaned by the laterally deflected thread rotating in the optical sensor and thus guarantees a safe transmission of the corresponding control signals.

BRIEF DESCRIPTIONS OF THE DRAWINGS

FIGS. 1, 2 and 3 show partial elevations of devices according to the invention with diagrammatically illustrated parts of a power loom, each in a different embodiment;

FIG. 4 shows a detail from FIG. 1 in a larger representation in a partial longitudinal section;

FIGS. 5 and 6 each shows a detail from FIG. 2 in a corresponding representation in a different embodiment; and FIG. 7 shows a detail from FIG. 3 in a corresponding representation.

DESCRIPTION OF THE PREFERRED EMBODIMENTS

As shown by the greatly simplified representation in FIG. 1, a weft thread 2 coming from a fixed weft thread supply bobbin 1 is guided through a fixed guide eyelet 3 and by a monitoring appliance 4 towards a thread storage or weft accumulator 5 and on through an eyelet 6 in a pneumatic weft insertion nozzle 7. The weft thread 2 is inserted via the weft insertion nozzle 7 along arrow 8 into a shed of a power loom (not shown).

The thread storage 5 contains a fixed drum-like wound package 10 and a thread guide 12 which can rotate about its axis 11 and which as shown is connected via a belt drive 13 to a drive device 14 and can be intermittently driven thereby. The thread guide 12 contains a hollow guide shaft 15 and a hollow winding arm 16 for guiding the weft thread 2, which is wound by the winding arm 16 onto the wound package 10 and is intermittently unwound from the top thereby in the axial direction via the weft insertion nozzle 7 for each weft insertion. The drive appliance 14 can be controlled by a control appliance 17 of the power loom, which can be influenced by control signals from the monitoring appliance 4.

As can be seen from FIG. 4 in particular, the winding shaft 15 of the thread guide 12 having an inlet channel disposed eccentrically with respect to its axis of rotation 11 is designed in the form of a bore 18, through which, when the winding arm 16 rotates the weft thread 2 is laterally deflected on the guide eyelet 3 disposed coaxially to the axis 11 and is guided around the axis of rotation 11 corresponding to the path of the thread represented by solid lines and a path of the thread 2' represented by broken lines an appearing after half a rotation of the winding shaft 15. The monitoring device 4 contains an optical sensor 20 constructed in the form of a guide eyelet, which in a control ring contains a transmitter 21 and a receiver 22 for light beams. The weft thread 2 rotating conically around the axis 11 when the thread guide 12 is driven produces a control signal, which is absent should the weft thread break. If this control signal should be absent during a drive phase of the thread guide 12, the drive appliance 14 and the power loom are accordingly switched off via the control device 17.

The supply bobbin 1 may be disposed in a position coaxial to the wound package 10 or in an angular position, in which its longitudinal axis together with the axis 11 of the wound package 10 forms an optional angle $\alpha$, which may be 90°, for example, as shown in FIG. 2. As can be seen from FIGS. 2 and 5, the thread guide 10 may comprise a winding shaft 15*a* with an inlet channel in the form of a bore 18*a* and centered with respect to the axis 11 and a guide piece 23 which can be attached on the winding shaft 15*a* and which contains a guide eyelet 24 for the weft thread 2 which can be adjusted according to the arrows 9 at a desired axial distance from the inlet side of the winding shaft 15*a* and is disposed eccentrically to the axis 11. As shown in FIG. 6, a corresponding guide piece 23*a* which can be placed on the winding shaft 15*a* may be designed with a bore 19 extending obliquely to the axis 11, which comprises a correspondingly eccentric inlet aperture for the weft thread 2. The guide pieces 23 and 23*a* may be manufactured from a plastic.

Even with these designs the weft thread 2 guided through the guide eyelet 24 or through the bore 19 respectively is deflected in the aforementioned way with respect to the axis of rotation 11 and is guided around said axis, with it being possible to produce the corresponding control signals via the monitoring appliance 4. This design permits in particular the use of the arrangement specified by the invention in conjunction with existing thread storage devices, in which the winding shaft is designed in a known way with a central inlet channel. Accordingly the winding shafts of known thread storage devices may also be provided with a guide piece 23 or 23*a*, which enables the lateral deflection of the weft thread 2 and consequently cooperation with the optical monitoring device 4 disposed as specified by the invention. It is obvious that a winding shaft 15 having an eccentric bore 18 may also be provided with a corresponding guide piece 23 or 23*a*, as a result of which it is possible to achieve a stronger deflection of the weft thread 2, for example.

According to FIG. 3 the weft thread 2 can be guided in a section extending roughly at right angles to the axis of rotation 11 towards the thread guide 12, which in this embodiment comprises a winding shaft 15*b* with a front surface 25 inclined to the axis of rotation 11. The winding shaft 15*b* can also be designed with a centered bore or, as shown in FIG. 7, with a bore 18 eccentric to the axis 11. As shown in FIG. 7, with a rotation of the winding shaft 15*b* the weft thread 2 can be periodically deflected by a distance A from the position shown by solid lines into the position 2' shown by broken lines and returned to the position shown with solid lines. In the angular position 15*b'* shown with dot-dash lines, which is offset by 180° with respect to the position of the winding shaft 15*b* shown by solid lines, the weft thread 2 is deflected at the correspondingly rounded transition part 26 between the front surface 25 and the circumferential surface of the winding shaft 15*b* and guided along the front surface 25 into the bore 18. With this design a lateral deflection of the weft thread 2 running towards the winding shaft 15*b* at an angle can simply be achieved, and the design shown having the eccentric bore enables a correspondingly stronger deflection in comparison with a design having a centered bore.

Designs having different guide means for the lateral deflection of the weft thread are also possible, e.g. a deflection component for the weft thread 2 which can be driven as required and move can at right angles to the path of the thread can be provided between the guide eyelet 3 and the thread guide 12.

What is claimed is:

1. A thread guiding device for use with a power loom having a fixed weft thread supply bobbin (1) and a thread storage (5) supplied with a weft thread from the bobbin, the thread guiding device comprising a thread guide (12), mounted for rotation about an axis of rotation (11), having an inlet channel (18, 18*a*) for the weft thread (2) and a thread guidance component (3) for the weft thread, the guidance component adapted to be located between the supply bobbin (1) and the thread storage and adapted to be fixedly mounted relative to the thread storage (5), the guide guiding the thread generally in the direction of the axis of rotation, a monitoring appliance (4) responsive to a path of the thread between the thread guidance component (3) and the thread storage (5) including an optical sensor (20) through which the weft thread (2) passes, and guide means cooperating with the thread guide for laterally deflecting a section of the weft thread (2) being supplied to the thread guide (12) and defined by the inlet channel (18) of the thread guide (12) being eccentrically offset with respect to the axis of rotation (11).

2. A thread guiding device for use with a power loom having a fixed weft thread supply bobbin (1) and a thread storage (5) supplied with weft thread from the bobbin, the thread guiding device comprising a thread guide (12) mounted for rotation about an axis of rotation (11), having an inlet channel (18, 18*a*) for the weft thread (2) and a thread guidance component (3) for the weft thread, the guidance component adapted to be located between the supply bobbin (1) and the thread storage and adapted to be fixedly mounted relative to the thread storage (5), the guide guiding the thread generally in the direction of the axis of rotation, a monitoring appliance (4) responsive to a path of the thread between the thread guidance component (3) and the thread storage (5) and including an optical sensor (20) through which the weft thread (2) passes, and guide means cooperating with the thread guide for laterally deflecting a section of the weft thread (2) being supplied to the thread guide (12), the guide means being defined by a front surface (25) of the thread guide 12 forming an inlet side of the inlet channel (18), the front surface being inclined with respect to the axis of rotation (11).

3. A thread guiding device for use with a power loom having a fixed weft thread supply bobbin (1) and a thread storage (5) supplied with weft thread from the bobbin, the thread guiding device comprising a thread guide (12), including a winding shaft (15) mounted for rotation about an axis of rotation (11), the winding shaft including an axially oriented inlet channel (18, 18*a*) for guiding the weft thread (2), a thread guidance component (3) for the weft thread, the guidance component adapted to be located between the supply bobbin (1) and the thread storage and adapted to be fixedly mounted relative to the thread storage (5), the guide guiding the thread generally in the direction of the axis of rotation, a monitoring appliance (4) responsive to a path of a thread section between the guidance component and the thread guide and including an optical sensor (20) positioned between the fixedly mounted guidance component (3) and the thread storage (5) through which the weft thread (2) passes, and guide means cooperating with the thread guide for laterally deflecting the thread section as it is being supplied to the thread guide (12) in a direction transverse to the path of the thread section between first and second positions which are offset with respect to each other.

4. A thread guiding device according to claim 3 wherein the inlet channel (18) of the thread guide (12) is eccentrically offset with respect to its axis of rotation (11).

5. A thread guiding device according to claim 3 wherein the guide means includes a guide piece (23, 23*a*) associated with the inlet side of the inlet channel (18*a*), mounted on the thread guide (12) and having a guide channel (19, 24) for the weft thread eccentrically disposed with respect to the axis of rotation (11) for deflecting the weft thread (2).

6. A thread guiding device according to claim 3, wherein the guide (12) forming an inlet side ofthe inlet channel (18), the front surface being inclined with respect to the axis of rotation (11).

* * * * *